US008567989B2

(12) United States Patent
Zeng et al.

(10) Patent No.: US 8,567,989 B2
(45) Date of Patent: Oct. 29, 2013

(54) HEAT SINK ASSEMBLY AND LIGHT

(75) Inventors: Yichong Zeng, Chelmsford, MA (US); Shiyong Zhang, Acton, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 119 days.

(21) Appl. No.: 13/422,172

(22) Filed: Mar. 16, 2012

(65) Prior Publication Data

US 2013/0242557 A1 Sep. 19, 2013

(51) Int. Cl.
*F28F 7/00* (2006.01)

(52) U.S. Cl.
USPC ..... 362/249.02; 362/373

(58) Field of Classification Search
USPC ..... 362/249.02, 240, 245, 310, 650, 373; 313/45, 46, 110, 113, 483, 498–501; 315/118, 185 R, 186, 247, 209 R, 291
See application file for complete search history.

(56) References Cited

U.S. PATENT DOCUMENTS

| | | | | |
|---|---|---|---|---|
| D528,227 | S | 9/2006 | Chou et al. | |
| D542,425 | S | 5/2007 | Wang | |
| D566,300 | S | 4/2008 | Lo | |
| D570,504 | S | 6/2008 | Maxik et al. | |
| 2007/0279862 | A1 | 12/2007 | Li | |
| 2010/0109499 | A1 | 5/2010 | Vilgiate et al. | |
| 2010/0187963 | A1 | 7/2010 | Vaccaro | |
| 2010/0207534 | A1 | 8/2010 | Dowling et al. | |
| 2010/0259934 | A1* | 10/2010 | Liu et al. | 362/294 |
| 2011/0267821 | A1* | 11/2011 | Van De Ven et al. | 362/249.02 |

OTHER PUBLICATIONS

Brochure "Sylvania ULTRA LED Retrofit PAR 38 Lamp", depicting in perspective view PAR38 lamp on sale in US prior to present application's filed, depicted in Osram Sylvania color brochure RETRO028R6 dated Oct. 2010 including "Lamp Dimensions" & "Lighting Facts" (3 pgs., color).

LEDs Magazine article "Osram Sylvania claims PAR38 LED lamp record", published Mar. 22, 2011, and including public comments attributed to Ed Rodriguez, OptoThermal Technologies Inc.; viewed on website http://www.ledsmagazine.com/news/8/3/16 visited Feb. 27, 2012 (1pg).

Osram Sylvania Media Release "Osram Sylvania LED Bulb Sets New Industry Record" published Mar. 18, 2011 bearing legend "this was posted externally on Mar. 10, 2011", containing no photograph; viewed on website http://sylvania.com/corpcom/Current/OSI_LED (one page).

* cited by examiner

*Primary Examiner* — Anh Mai
*Assistant Examiner* — Elmito Breval
(74) *Attorney, Agent, or Firm* — Edward S. Podszus

(57) ABSTRACT

A heat sink for a light emitting diode (LED) lamp assembly includes a core region having a lower end, an upper end, a first region configured to receive an electrical connector, a second region configured to receive at least one LED, and a plurality of longitudinal vanes extending outwardly from the core region, and an upper thermal ring intersecting with and supported by the vanes. The heat sink further includes webs formed between adjacent pairs of the longitudinal vanes, the webs collectively defining an auxiliary thermal ring, the auxiliary thermal ring substantially circumferentially surrounding in spaced relation the core region and disposed, as viewed in the longitudinal direction, between the upper thermal ring and the lower rim. Each of the longitudinal vanes defines a respective thermal notch formed on a vane surface facing an adjacent longitudinal vane, the thermal notch being in confronting relationship to a respective air low aperture.

11 Claims, 15 Drawing Sheets

104

104

104

HEAT SINK ASSEMBLY AND LIGHT

CROSS-REFERENCE TO RELATED APPLICATIONS

Not applicable.

FIELD

The present disclosure relates generally to heat sinks, and, more particularly, to a heat sink assembly for solid-state light sources.

BACKGROUND

Solid-state lighting may include one or more LEDs as a source of illumination and provide numerous benefits including, but not limited, increased efficiency and lifespan. Similar to other types of lamps, an LED lamp emits energy in the form of radiant energy and heat. The heat generated by the lamp can cause problems (such as, but not limited to, reduced lifespan and reduced lumen output). As such, proper management of thermal energy within an LED lamp may result in improved life, decrease package size, and in some cases, improve lumen output. An additional benefit of removing thermal energy from the lamp is that the lamp can be operated in a higher ambient temperature environment without compromising life or performance of the lamp.

One common application for LED lamps is a PAR38 lamp such as, but not limited to, an Ultra LED retrofit PAR38 lamp 10, FIG. 1, available from Osram Sylvania Inc. (the assignee of the present application). The Ultra LED retrofit PAR38 lamp 10 of FIG. 1 includes a heat sink 12 configured to reduce the LED junction temperature. Other examples of heat sinks are described in U.S. Des. Pat. No. 542,425 (Wong), U.S. Pat. Pub. No. 2010/0207534 (Maxik), U.S. Pat. Pub. No. 2010/0109499 (Vilgiate), U.S. Pat. Pub. No. 2010/0187963 (Vaccaro), and U.S. Pat. Pub. No. 2007/0279862 (Li).

BRIEF DESCRIPTION OF THE DRAWINGS

Reference should be made to the following detailed description which should be read in conjunction with the following figures, wherein like numerals represent like parts.

Figure 1:
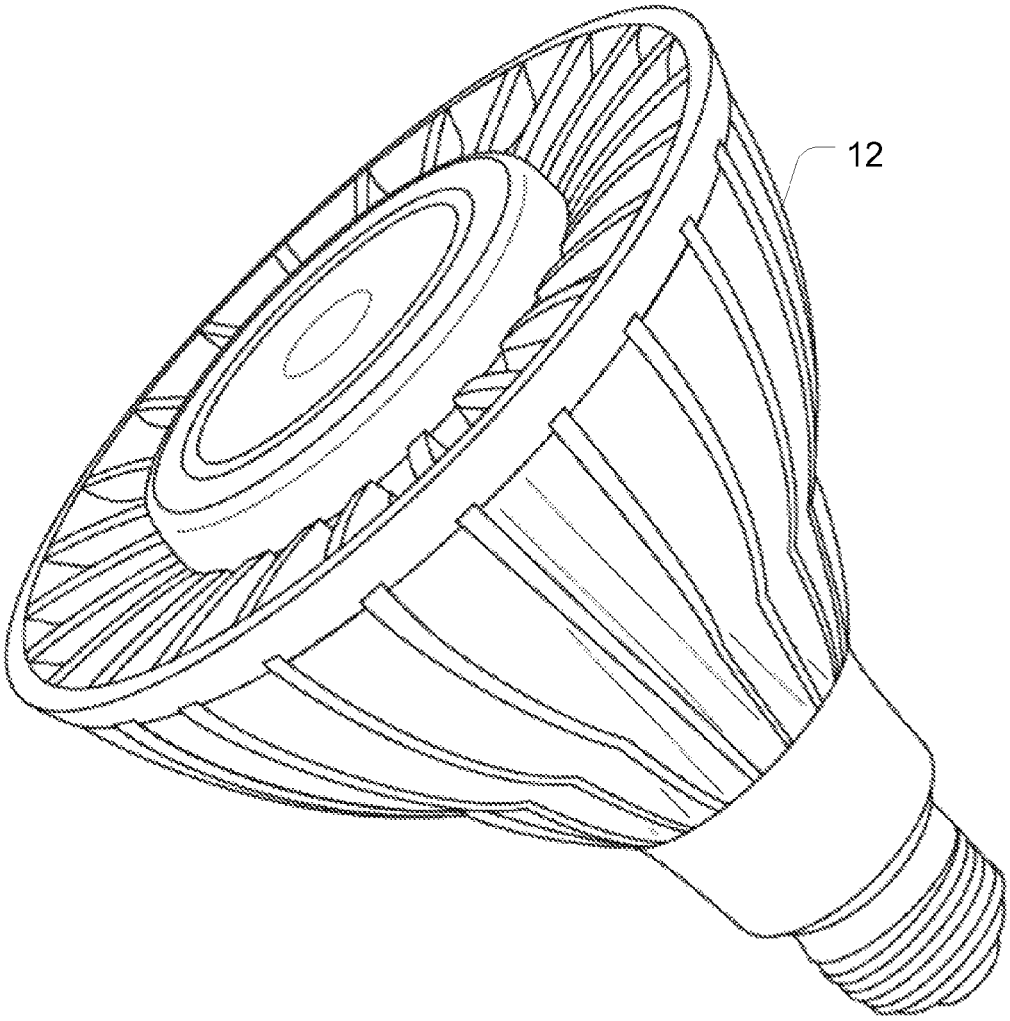
FIG. 1 PRIOR ART
FIG. 1 generally illustrates one embodiment of a prior art LED lamp and heat sink available from the assignee of the present disclosure.

For a thorough understanding of the present disclosure, reference should be made to the following detailed description, including the appended claims, in connection with the above-described drawings. Although the present disclosure is described in connection with exemplary embodiments, the disclosure is not intended to be limited to the specific forms set forth herein. It is understood that various omissions and substitutions of equivalents are contemplated as circumstances may suggest or render expedient. Also, it should be understood that the phraseology and terminology used herein is for the purpose of description and should not be regarded as limiting.

DETAILED DESCRIPTION

By way of a brief overview, one embodiment of the present disclosure features a heat sink having improved thermal dissipation performance which can be used in conjunction with at least one a light emitting diode (LED) and an electrical connector to form a LED lamp assembly. As explained herein, the heat sink includes a core region, a plurality of fins, an upper thermal ring, an auxiliary thermal ring, and a plurality of thermal notches which collectively increases the thermal contact area and increases the air flow across heat sink, thereby allowing the heat sink to dissipate more thermal energy to the surrounding ambient air. More specifically, the heat sink includes a core region having an upper region, a lower region, a plurality of fins or vanes (as used herein, the terms fins or vanes may be used interchangeably) extending generally outwardly from the core region, and an upper thermal ring. The upper and lower regions are configured to operatively engage with the LEDs and the electrical connector, respectively. The upper thermal ring intersects with and is supported by the plurality of fins such that the upper thermal ring extends substantially about an entire circumference of the heat sink in a spaced relation from the upper region. The plurality of fins and the upper thermal ring define a plurality of air flow aperture extending along the longitudinal axis of the heat sink. The heat sink also includes a plurality of webs formed between adjacent pairs of longitudinal fins. The webs collectively define an auxiliary thermal ring substantially circumferentially surrounding in a spaced relation from the core region. The auxiliary thermal ring is also disposed, as viewed in the longitudinal direction, between the upper thermal ring and a lower rim of the lower region. Each of the fins defines a respective thermal notch formed on a fin surface facing an adjacent fin, wherein the thermal notch is in a confronting relationship to a respective air flow aperture.

A heat sink assembly consistent with at least one embodiment of the present disclosure may provide numerous advantages. For example, a heat sink assembly consistent with the present disclosure increases the effective thermal contact area of the heat sink with the surrounding ambient air while also unexpectedly increasing the airflow across the heat sink. As a result, the heat sink transfers more thermal energy from the LEDs to the surrounding ambient air. Consequently, the thermal performance of the heat sink may be increased, the LED's junction temperature may be reduced, and the total lumen output of the LED's may be increased.

Figure 2:
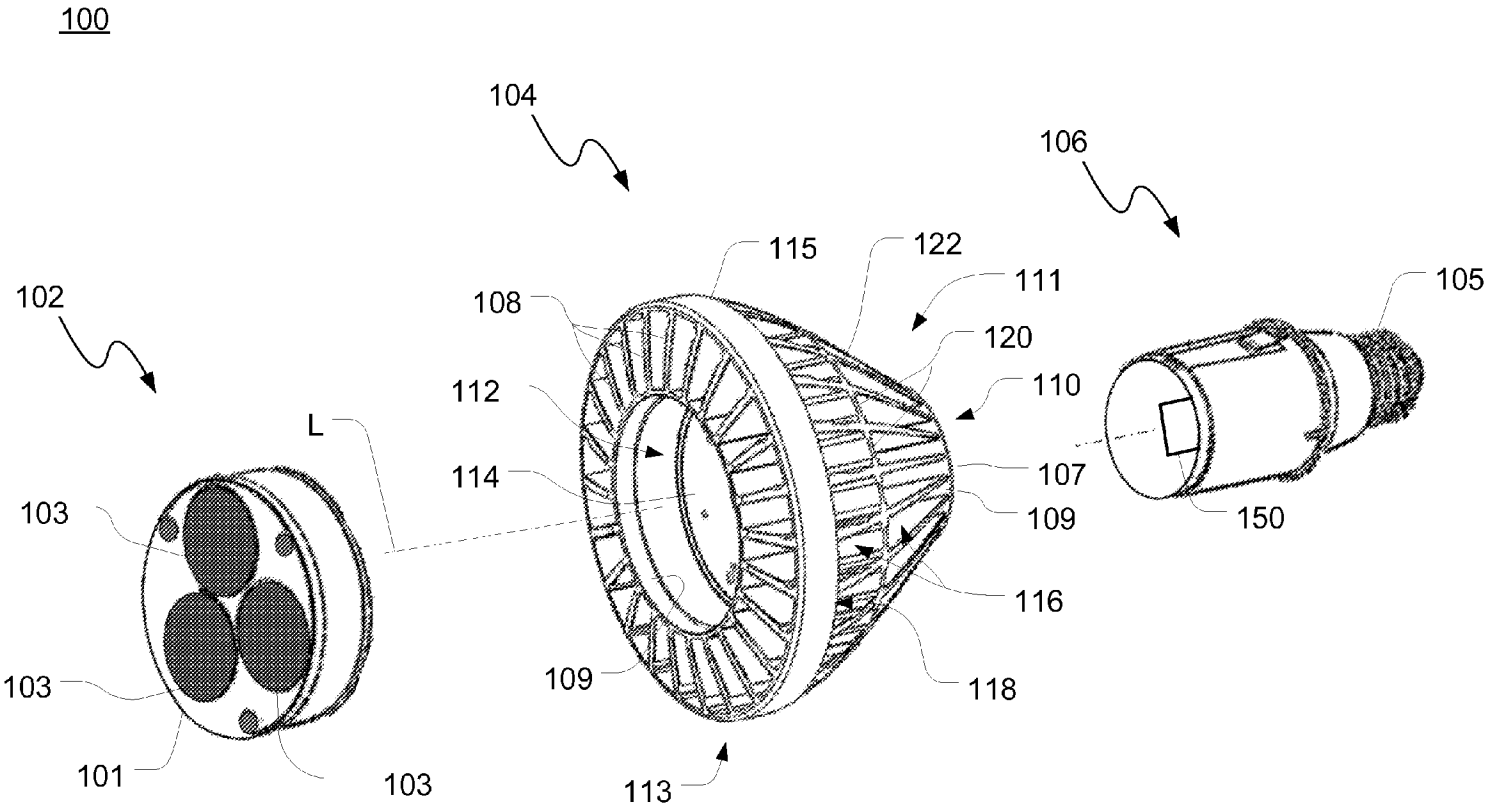
FIG. 2 generally illustrates an exploded view of one embodiment of an LED lamp consistent with the present disclosure.

Turning now to FIG. 2, an exploded perspective view of one embodiment of a solid-state lighting lamp assembly 100 (hereinafter generally referred to as an LED lamp 100 for convenience) is generally illustrated. While the LED lamp 100 is illustrated having an overall shape compatible with a PAR38 lamp, it should be understood that the LED lamp 100 is not limited to a PAR38 lamp unless specifically claimed as such. The LED lamp 100 generally includes a light module 102, a heat sink 104, and an electrical module 106. By way of a brief overview, the light module 102 include at least one solid state light engine 103 (e.g. a LED) which may be secured to a housing/body portion 101.

The electrical module 106 is configured to be electrically and/or mechanically coupled to an external power supply (e.g. an electrical socket coupled to an AC or DC power source, not shown) and provide power to the light module 102 and components thereon (e.g., but not limited to, the LEDs 103 of the light module 102). The heat sink 104 is configured to transfer heat generated by the light module 102 and/or electrical module 106 to a fluid medium, such as ambient air or liquid.

According to one embodiment, the light module 102 and electrical module 106 are configured to be selectively attached and detached with the heat sink 104. When the LED lamp 100 is assembled, the light module 102 and the electrical module 106 are electrically coupled. The electrical module 106 includes an electrical connector 105 (such as, but not limited to, include an Edison screw base) configured to be electrically and/or mechanically coupled to an external power supply. While the electrical connector 105 is illustrated as an Edison screw base, it should be appreciated that the LED lamp 100 may be used with any electrical connector 105. Additionally, it should be appreciated that the electrical connection to the power source may be separate from the mechanical connection to secure the LED lamp assembly 100. While the light module 102, heat sink 104, and electrical module 106 will generally be described as being selectively attachable/detachable, the light module 102 and/or electrical module 106 may be permanently secured to the heat sink 104 such that the light module 102, the electrical module 106, and/or the heat sink 104 may not be removed without damaging one or more of the components.

As mentioned above, the heat sink 104 is configured to transfer heat generated by the light module 102 and/or electrical module 106 to a fluid medium, such as air or liquid. The heat sink 104 may be constructed from a variety of materials, such as, but not limited to, thermal plastics, aluminum, copper, or an alloy thereof and may include a monolithic (i.e., one-piece) or integral component. The size, shape, and configuration of the heat sink 104 may depend on the intended application (e.g., the desired amount of heat to be transferred). For example, the overall shape of the heat sink 104 may be confined by the maximum dimensions of a PAR38 lamp.

The heat sink 104 includes a core region 109 formed about a longitudinal axis L of the heat sink 104 having a plurality of heat-radiating fins or vanes 108 extending generally outwardly from the core region 109. The plurality of fins 108 are configured to increase the surface area of the heat sink 104 and dissipate thermal energy generated by the light module 102 and/or electrical module 106 to the surrounding air and may include, but are not limited to, straight fins and/or flared fins.

According to one embodiment, the plurality of longitudinal fins 108 extends parallel to the longitudinal axis of the heat sink 104 as generally illustrated in the figures, though it should be appreciated that the present disclosure is not limited to such an arrangement unless specifically claimed as such. Optionally, the fins 108 may have a curvature. Additionally, while the plurality of fins 108 are illustrated extending along substantially the entire length of the core region 109, the fins 108 may extend along only a portion of the length of the core region 109. Moreover, while the fins 108 are illustrated having a taper which decreases from one end of the core region 109 to the other end, this is not a limitation of the present disclosure unless specifically claimed as such and the configuration of the fins 108 will depend upon the intended application.

The core region 109 includes a first and a second region 110, 112 disposed about a lower end 111 and an opposite upper end 113, respectively. The first region 110 is configured to receive at least a portion of the electrical module 106. According to one embodiment, the first region 110 may form a generally cylindrical cavity (not shown) defining a lower peripheral rim 107 having dimensions closely matching a portion of the electrical module 106 (e.g., to increase heat transfer from the electrical module 106 into the heat sink 104). The first region 110 may include a locking mechanism/feature configured to cooperate with the electrical module 106 to couple, mount, or otherwise secure the electrical module 106 to the heat sink 104. The locking feature may include, but is not limited to, a groove or slot configured to engage with a corresponding locking feature on the electrical module 106 (e.g., a tab or protrusion, not shown) in a locking fashion, snap connections, threaded connections, interference connections, screws (e.g., a set screw), bolts, clamps, fasteners, and the like (not shown).

The second region 112 of the heat sink 104 is configured to receive at least a portion of the light module 102 such that light is emitted generally outward from the heat sink 104. According to one embodiment, the second region 112 may form a cavity having dimensions closely matching a portion of the light module 102 (e.g., to increase heat transfer from the light module 102 into the heat sink 104). While the second region 112 is illustrated defining a generally cylindrical cavity, the second region 112 may define non-cylindrical cavities.

The second region 112 includes a base 114. According to one embodiment, the first and second regions 110, 112 are disposed at generally opposite ends 111, 113 of the heat sink 104 and are separated by the base 114 of the second region 112. The second region 112 is configured to receive the light module 102 such that a portion of the light module 102 engages the base 114 to facilitate thermal energy transfer from the light module 102 into the base 114 of the heat sink 104. The second region 112 includes a locking mechanism/feature configured to cooperate with the light module 102 to couple, mount, or otherwise secure the light module 102 to the heat sink 104. The locking feature includes, but is not limited to, an optical cover (not shown), a groove or slot configured to engage with a corresponding locking feature on the light module 102 (e.g., a tab or protrusion, not shown) in a locking fashion, snap connections, threaded connections, interference connections, screws (e.g., a set screw), bolts, clamps, fasteners, and the like (not shown).

The heat sink 104 also includes an upper thermal ring 115 formed proximate to the upper end 113. The upper thermal ring 115 is arranged in a spaced relation from the core region 109 and extends substantially about an entire perimeter or circumference of the heat sink 104. The plurality of fins 108 intersect and support the upper thermal ring 115 as generally illustrated. The fins 108 and the upper thermal ring 115 bound or define, when viewed in a direction along the longitudinal axis L of the heat sink 104, a plurality of air flow apertures 116, 117 (see, for example, FIGS. 3 and 4 which generally illustrate an upper end view and a lower end view of the heat sink 104, respectively). The upper thermal ring 115 defines a lower peripheral ring surface 118 (e.g., as generally illustrated in FIG. 5) facing generally towards the lower end 111. The upper thermal ring 115 increases the surface area for thermal transfer and airflow through the heat sink 104, thereby increasing the amount of thermal energy that the heat sink 104 dissipates. Additionally, the upper thermal ring 115 increases the rigidity of the plurality of fins 108 by connecting the fins 108, thereby reducing the potential of the fins 108 being damaged during handling, mishandling, or the like.

Figure 3:
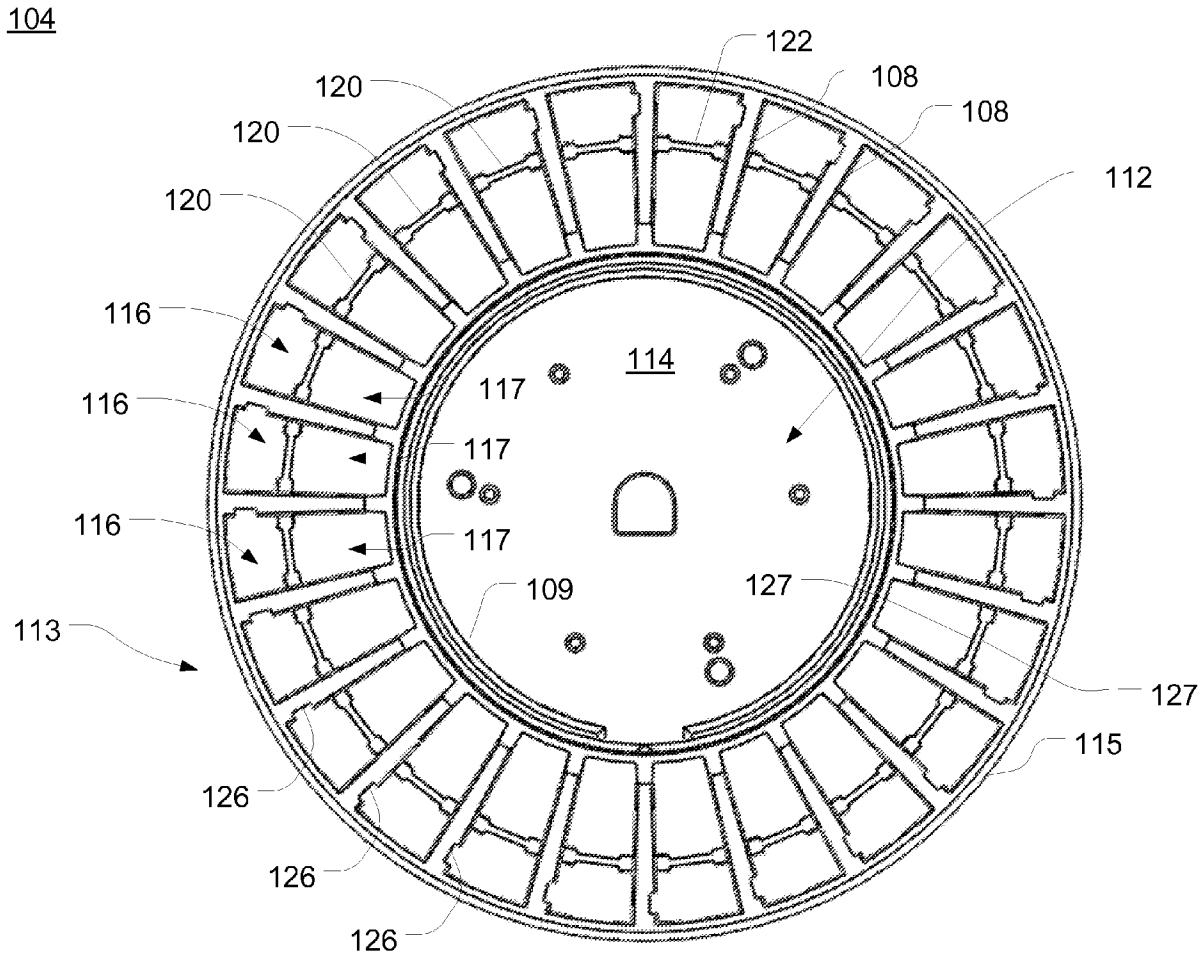
FIG. 3 generally illustrates an end view of the LED lamp of FIG. 2.
Figure 4:
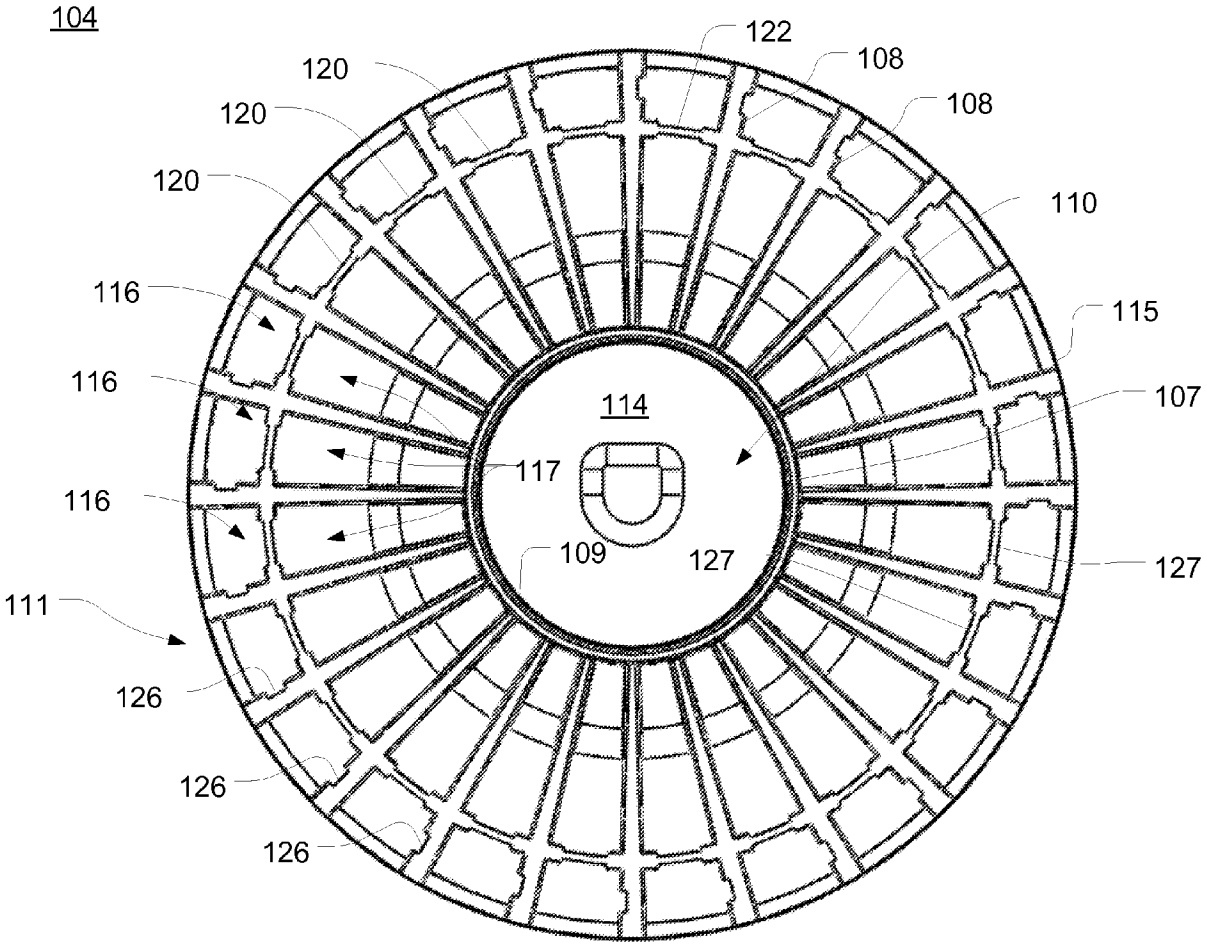
FIG. 4 generally illustrates another end view of the LED lamp of FIG. 2.
Figure 5:
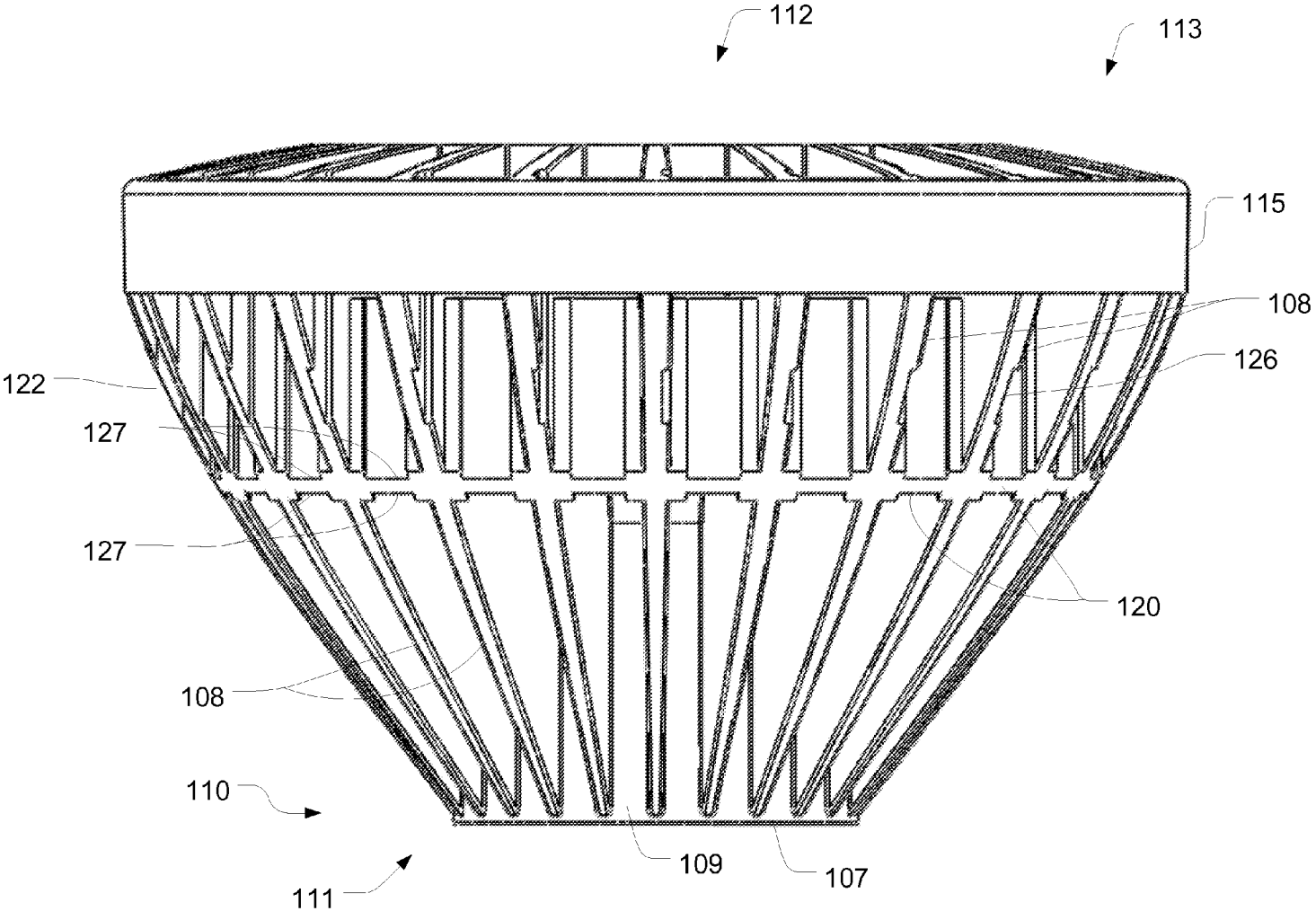
FIG. 5 generally illustrates a side view of the LED lamp of FIG. 2.
Figure 6:
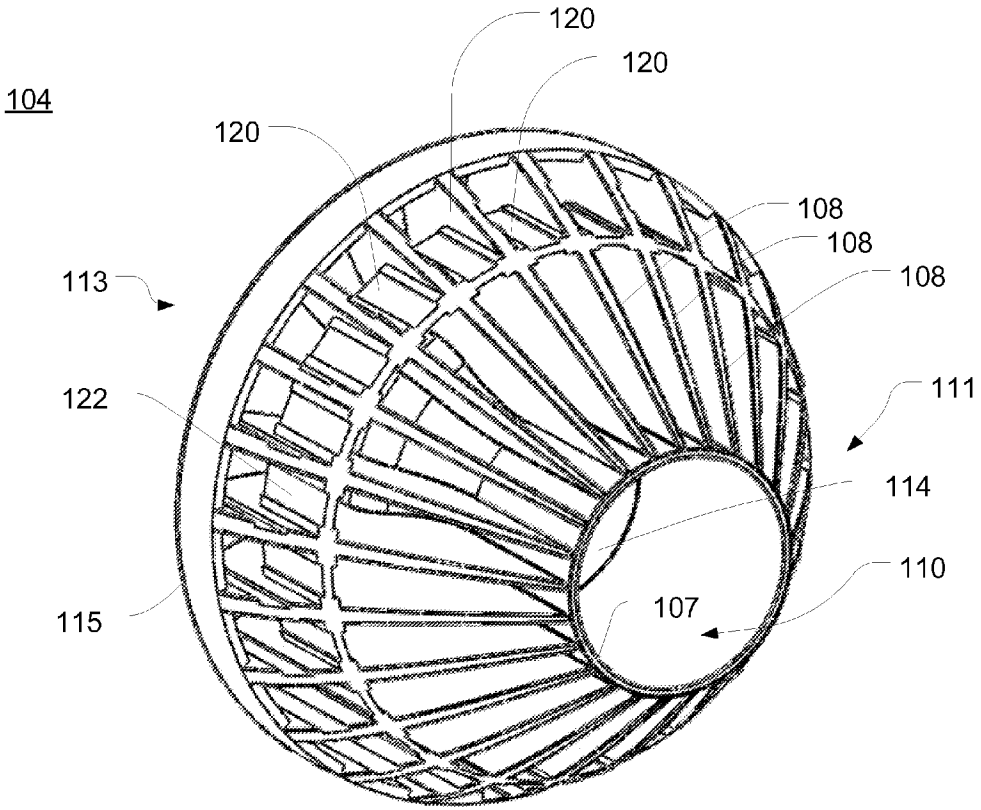
FIG. 6 generally illustrates an end perspective view of the LED lamp of FIG. 2.

With further reference to FIGS. 3 and 4, the heat sink 104 further includes a plurality of webs 120 formed between adjacent pairs of the plurality of fins 108. The plurality of webs 120 collectively define an auxiliary thermal ring 122. The auxiliary thermal ring 122 substantially circumferentially surrounds in a spaced relation the core region 109. When viewed along the longitudinal axis of the heat sink 104 (see, for example, FIGS. 5 and 6 which generally illustrate a side view and a lower end perspective view of the heat sink 104), the auxiliary thermal ring 122 is disposed between the upper thermal ring 115 and the lower rim 107.

The auxiliary thermal ring 122 further increases the amount of thermal energy that the heat sink 104 can dissipate. In particular, the heat dissipation capability of the fins 108 may be limited, particularly when thin fins 108 are used, because of reduced dissipating cross-sectional areas. While it is possible to increase the thickness of the fins 108, the total number of fins 108 may be reduced and/or the airflow across the fins 108 may be reduced. The auxiliary thermal ring 122 of the present disclosure connects all of the fins 108 and adds an extra thermal conducting path for better thermal dissipating capability. Additionally, the auxiliary thermal ring 122 may allow for the use of thinner fins 108, which may reduce the amount of material needed to manufacture the heat sink 104, thereby reducing the cost to manufacture the heat sink 104 and further reducing the overall weight of the heat sink 104. Depending on the material used to manufacture the heat sink 104, the auxiliary thermal ring 122 may be made through die-casting or stamping (e.g., but not limited to, when using copper, aluminum, or alloys thereof) or injection molding for thermal plastics.

The heat sink 104 also includes one or more thermal notches 126, 127. The thermal notches 126, 127 increase the surface area for thermal transfer, thereby increasing the amount of thermal energy dissipated by the heat sink 104. Additionally, the thermal notches 126 increase the size of the airflow passages 116, 117, thereby increasing the airflow through the heat sink 104 and increasing the amount of thermal energy dissipated by the heat sink 104. For example, without the use of the thermal notches 126, 127, the air passages 116, 117 surrounding the fins may be very narrow which may limit the amount of air flowing through the heat sink. As a result, the amount of thermal energy dissipated by the heat sink may be reduced, despite a relatively large amount of surface area for thermal transfer. In contrast, the thermal notches 126, 127 of the present disclosure may allow for larger size airflow passages 116, 117, thereby reducing the restrictions to airflow across the fins 108 and increasing the amount of thermal energy dissipated by the heat sink 104. Moreover, because of the increased airflow through airflow passages 116, 117 of the heat sink 104, the thermal notches 126, 127 may allow for a higher density or total number of fins 108 which may further enhance the amount of thermal energy dissipated by the heat sink 104.

One or more of the thermal notches may be located on the plurality of fins 108 and/or the auxiliary thermal ring 122. For example, one or more of the plurality of fins 108 includes a thermal notch 126 disposed in a region adjacent the upper thermal ring 115 and the auxiliary thermal ring 122 (see, for example, FIGS. 4 and 5) which increases the airflow and thermal surface area in the aperture 116 (see, for example, FIGS. 3 and 4) between the upper thermal ring 115 and the auxiliary thermal ring 122. The thermal notch 126 extends longitudinally from a region slightly above the upper thermal ring 115 towards the lower portion of the auxiliary thermal ring 120 (see, for example, FIG. 4).

One or more thermal notches may be located on the plurality of webs 120 forming the auxiliary thermal ring 122. For example, one or more of the plurality of webs 120 includes a thermal notch 127 disposed between the plurality of webs 120 and the upper thermal ring 115 (see, for example, FIGS. 3 and 4) which increases the airflow and thermal surface area in the aperture 116 between the upper thermal ring 115 and the auxiliary thermal ring 122. One or more of the plurality of webs 120 also includes a thermal notch 127 disposed between the auxiliary thermal ring 122 and the core region 109 (see, for example, FIGS. 3 and 4) which increases the airflow and thermal surface area in the aperture 117 (see, for example, FIGS. 3 and 4) between the auxiliary thermal ring 122 and the core region 109.

The thermal notches 126, 127 may be made using various manufacturing processes such as, but not limited to, die casting, stamping, extrusion (e.g., but not limited to, extruding metal material), and/or injection molding (e.g., but not limited to, injection molding thermal plastics). Additionally, the thermal notches 126, 127 may reduce the amount of material needed to manufacture the heat sink 104, thereby reducing the cost to manufacture the heat sink 104 and further reducing the overall weight of the heat sink 104.

As noted above, the auxiliary thermal ring 122 may be disposed on the plurality of fins 108 between the upper thermal ring 115 and the lower rim 107. According to one embodiment, the auxiliary thermal ring 122 is entirely disposed between the lower peripheral ring surface 118 of the upper thermal ring 115 and a vane midway position (see, for example, FIG. 5). As used herein, the vane midway position is defined as a position along the plurality of vanes 108 generally midway between the lower peripheral ring surface 118 and the lower rim 107.

Figure 8:
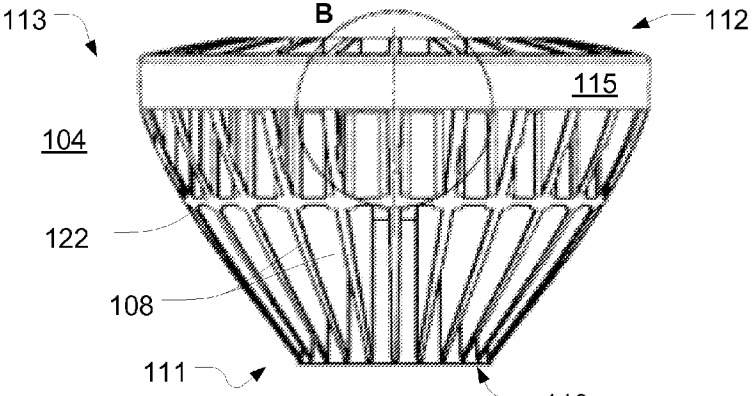
FIGS. 7-10 generally illustrate various dimensional relationships of the LED lamp of FIG. 2.
Figure 7:
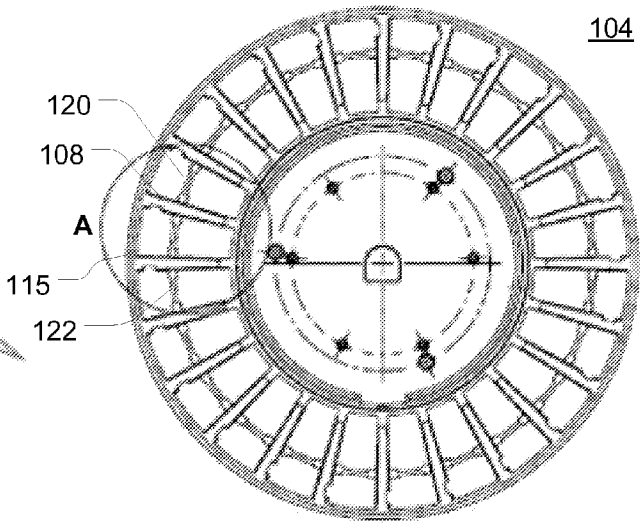
Figure 10:
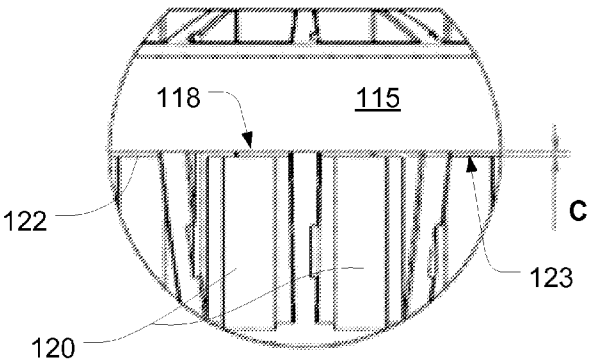
Figure 9:
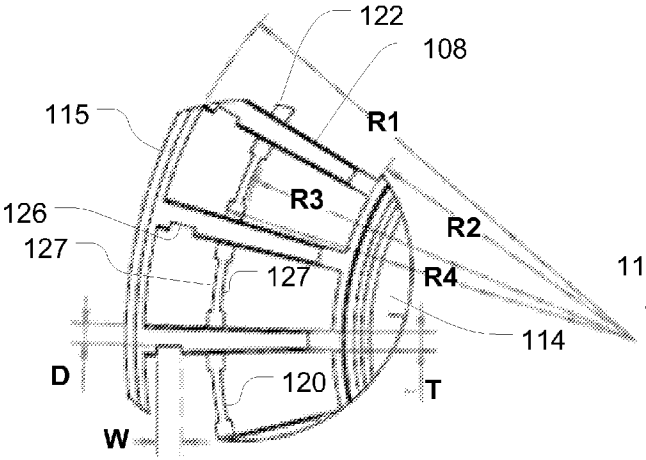

Turning now to FIGS. 7-10, and as will be explained in more detail below, one embodiment of a heat sink 104 consistent with the present disclosure is shown illustrating the various positional relationships R1, R2, R3, R4, D, W, and C of the auxiliary thermal ring 122, the upper thermal ring 115, second region 112. By way of a general overview, FIG. 7 illustrates an upper end view of the heat sink 104, FIG. 8 illustrates a side view of the heat sink 104, FIG. 9 illustrates a close-up of section A of the heat sink 104 from FIG. 7, and FIG. 10 illustrates a close-up of section B of the heat sink 104 from FIG. 8. Within these figures, R1 represents the inside wall radius of the upper thermal ring 115, and R2 represents an external wall radius of the base 114 of the second region 112. R3 represents the inside wall radius of, and R4 the external wall radius of, the auxiliary thermal ring 122, respectively. C represents the gap between the top surface 123 of the auxiliary thermal ring 122 and the lower peripheral ring surface 118 of the upper thermal ring 115, T represents the minimum thickness of the fins 108 (excluding the thermal notch 126) where the thermal notch 126 is located, D represents the wall thickness where the thermal notch 126 is located, and W represents the width of the thermal notch 126. The radii R1, R2, R3, and R4 are measured from the centerline of the heat sink 104, wherein the centerline is considered to be the center of the second region 112 congruent with the longitudinal axis L.

With the above in mind, the inventors of the present disclosure have discovered that the heat sink 104 unexpectedly dissipates more thermal energy when the following relationships are satisfied:

$$R2<R3<R1; \quad \text{Equation 1:}$$

$$R2<R4<R1; \quad \text{Equation 2:}$$

$$0.5*(R1+R2)<R3<0.75*(R1+R2); \quad \text{Equation 3:}$$

$$0.5*(R1+R2)<R4<0.75*(R1+R2); \quad \text{Equation 4:}$$

$$R3<R4; \quad \text{Equation 5:}$$

$$C>0; \quad \text{Equation 6:}$$

$$D \geq T; \text{ and} \quad \text{Equation 7:}$$

$$T \leq W \leq 2*T. \quad \text{Equation 8:}$$

Contrary to an initial impression that adding an additional thermal ring (i.e., the auxiliary thermal ring 122) would reduce the airflow across the heat sink 104, the inventors of the present disclosure have discovered that a heat sink 104 which satisfies the above relationships increases the airflow across the heat sink 104 while also increasing the thermal surface area. As a result, a heat sink 104 which satisfies the above relationships actually reduces the maximum temperature of the heat sink 104, which therefore corresponds to a lower junction temperature for the LEDs 103 of the light module 102.

Figure 11:
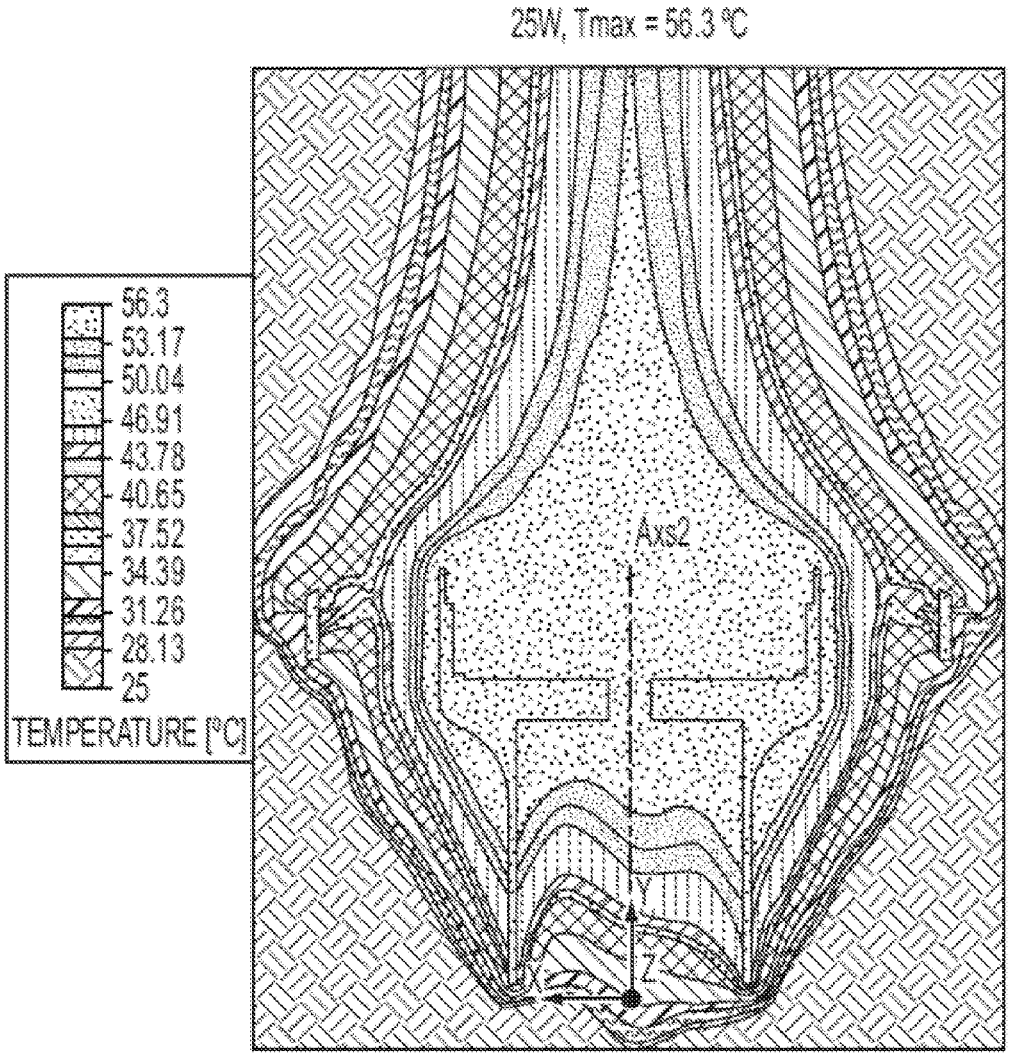
FIGS. 11 and 12 illustrate a thermal simulation for an conventional heat sink and a heat sink consistent with the present disclosure.
Figure 12:
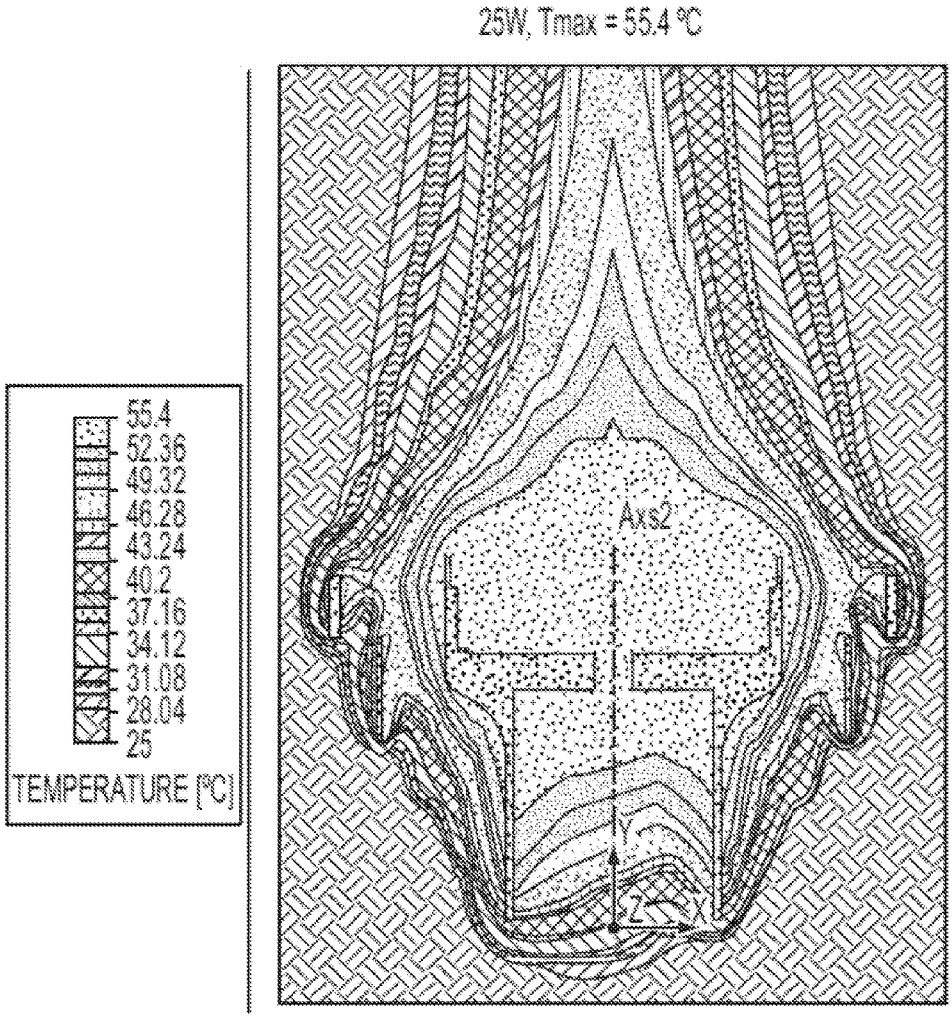
Figure 13:
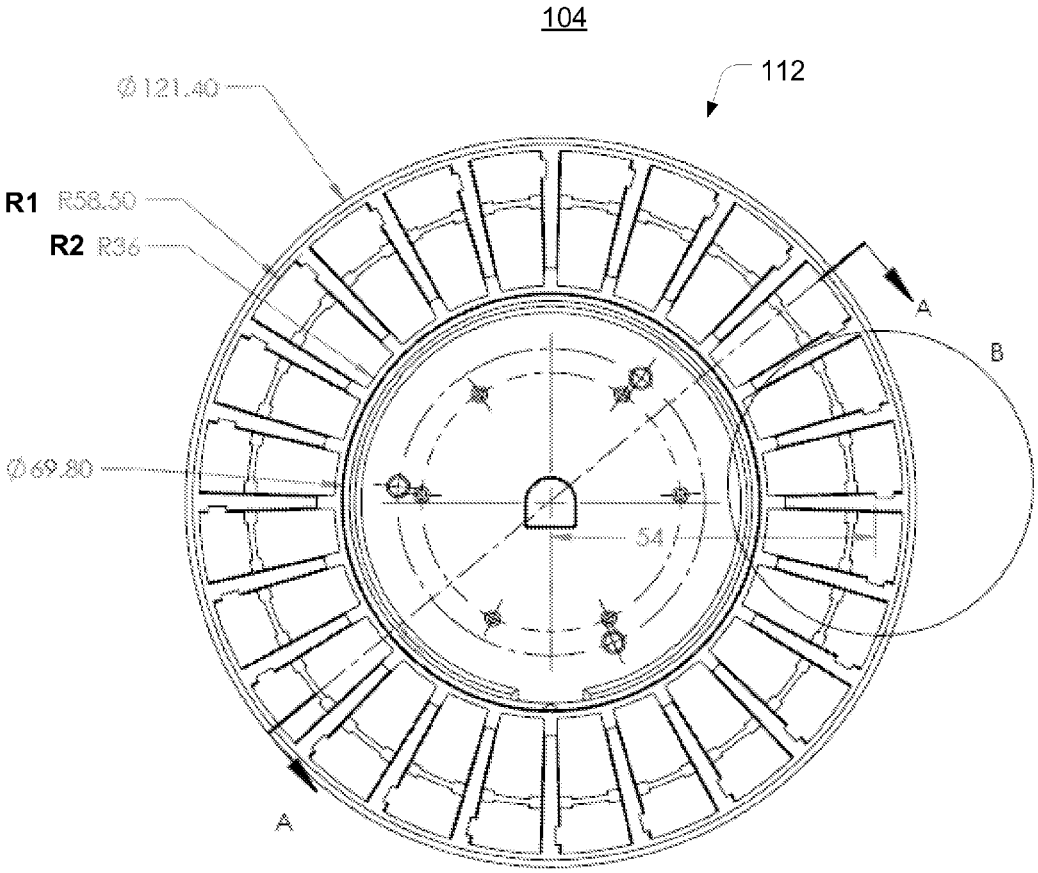
FIGS. 13-18 generally illustrate various dimensions for one embodiment of a heat sink consistent with the present disclosure.
Figure 14:
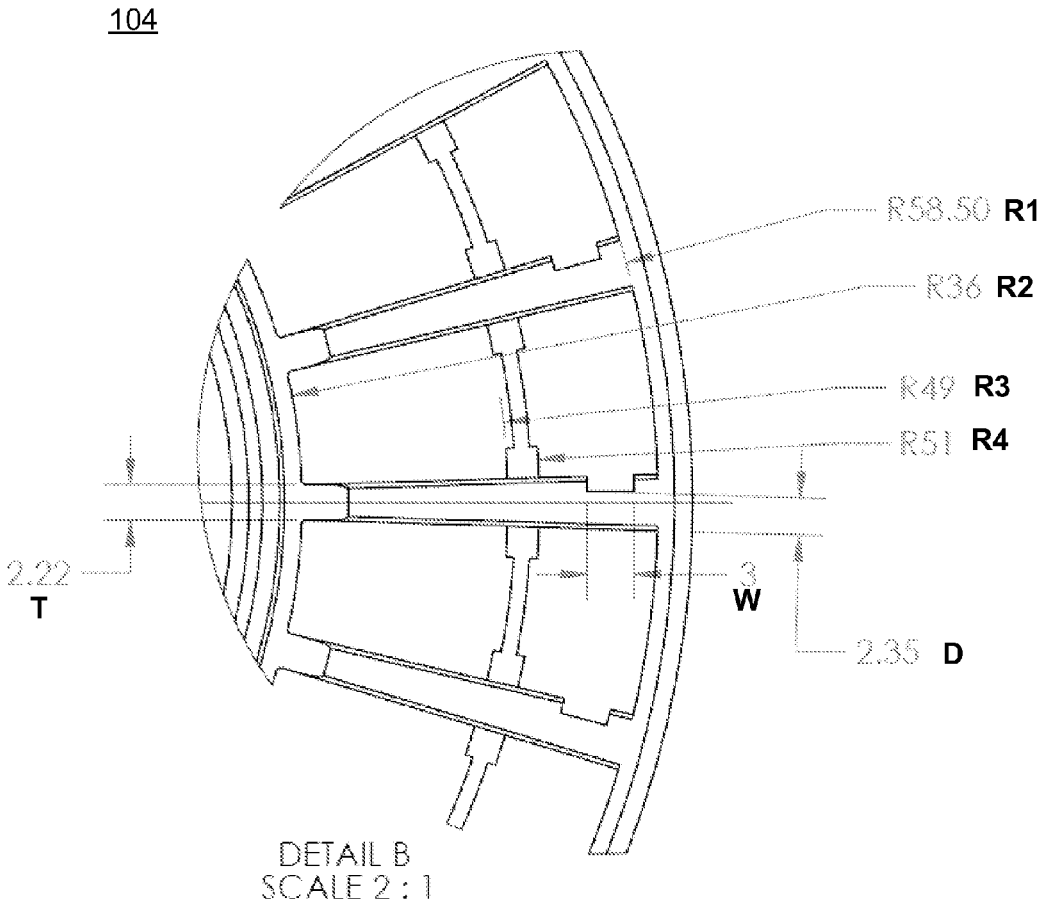
Figure 15:
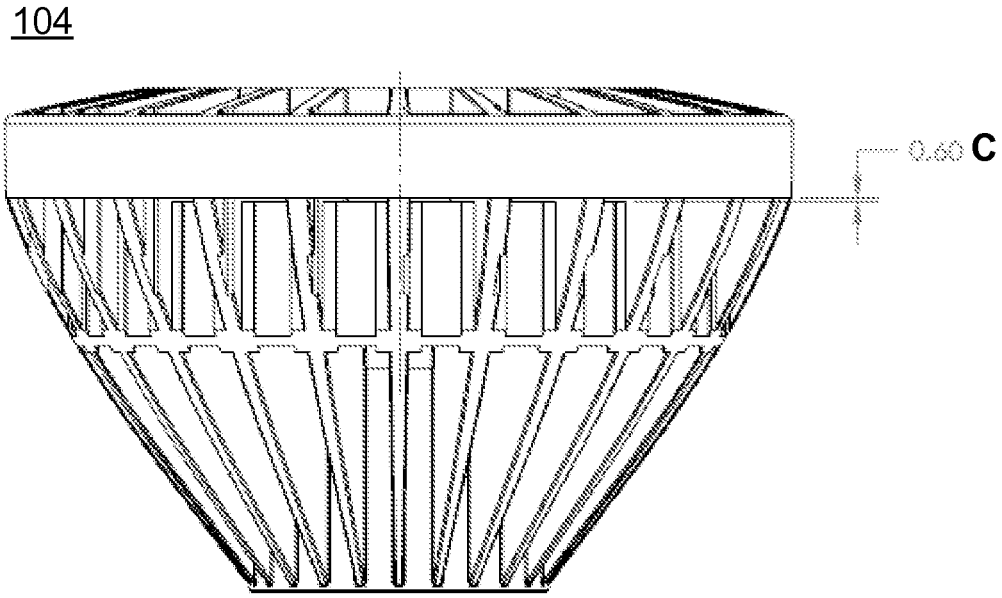
Figure 16:
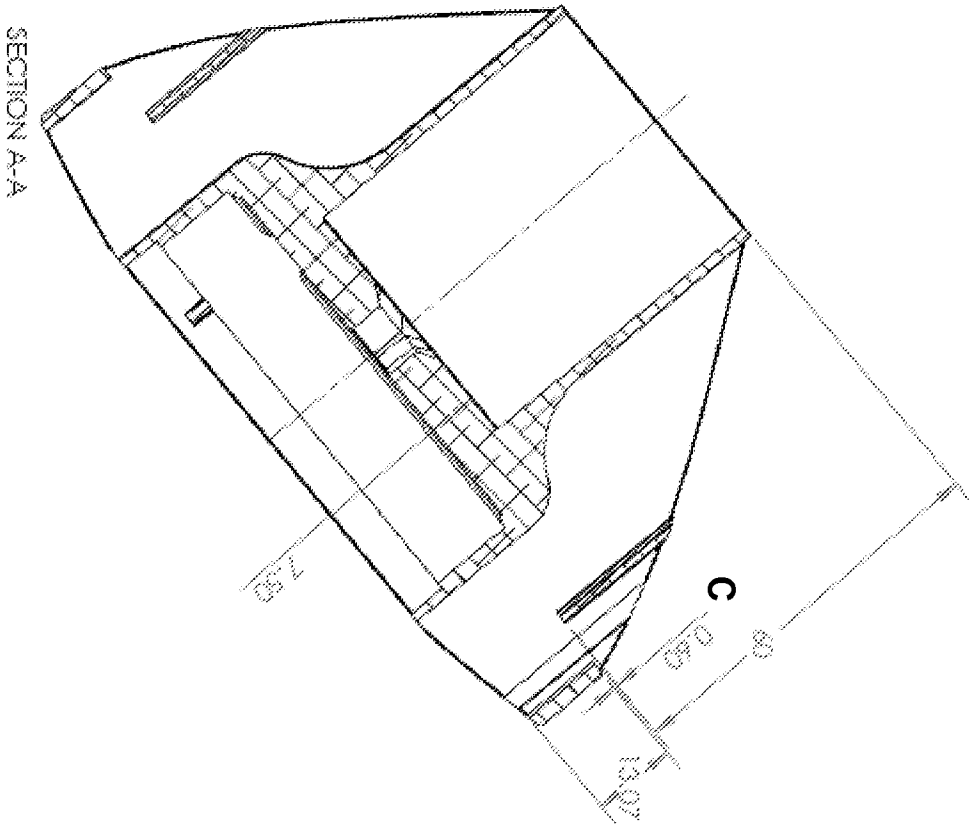
Figure 17:
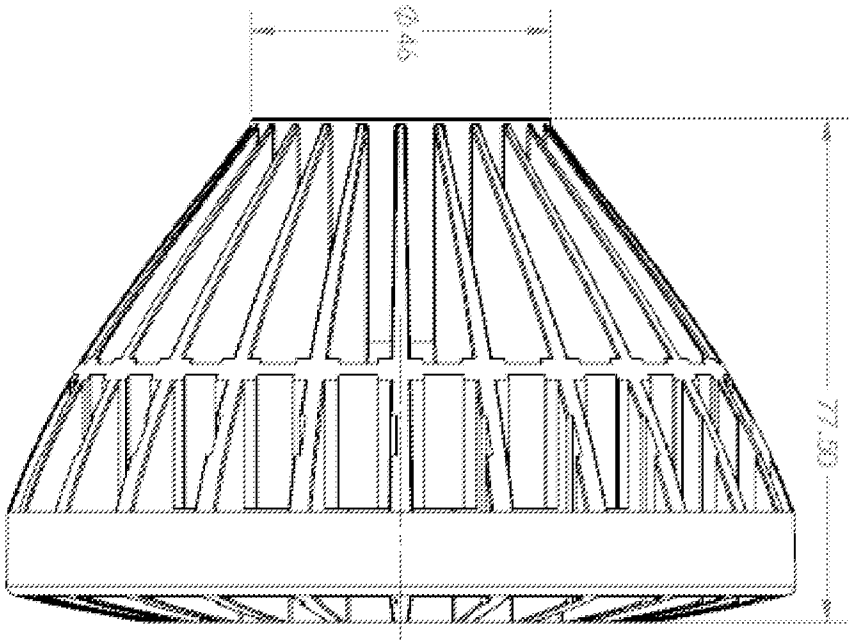
Figure 18:
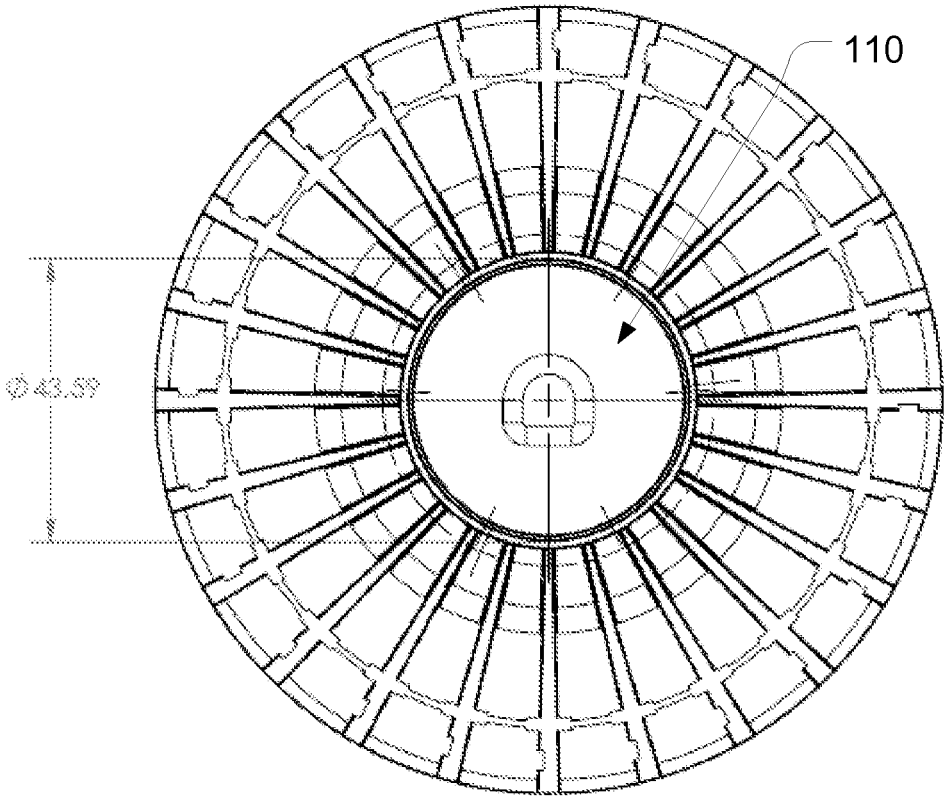

Turning now to FIGS. 11 and 12, thermal simulations for a heat sink without thermal notches and an auxiliary ring and a heat sink 104 consistent with FIGS. 7-10 (i.e., a heat sink 104 which includes thermal notches 126, 127 and an auxiliary ring 122) are generally illustrated. In each thermal simulation, a 25 watt heat source is mounted to the base 114 of the second region 112 where the light module 102 would be secured, and thermal images of the heat sinks and the surrounding air were measured. As may be seen, the heat sink without thermal notches and an auxiliary ring has a maximum temperature of 56.3° C. In contrast, the heat sink 104 consistent with FIGS. 7-10 has a maximum temperature of 55.4° C. As such, the heat sink 104 consistent with FIGS. 7-10 dissipates more thermal energy than a heat sink without thermal notches and an auxiliary ring. Because the thermal performance of a heat sink 104 consistent with the present disclosure is increased, the LED's junction temperature is reduced and the total lumen output of a lighting system 100 consistent with the present disclosure may be increased.

For example, a LED lamp 100 consistent with the present disclosure was tested and compared to other lamps. Table 1 below provides the results of this comparison.

TABLE 1

| | LED Lamp 100, FIG. 2 | OSRAM SYLVANIA ULTRA LED PAR38 LED 10, FIG. 1 | Standard PAR38 Halogen | Standard PAR38 HID |
|---|---|---|---|---|
| Watts | 24.3 | 18 | 100 | 24 |
| Lumens | 1650 | 900 | 1500 | 1220 |
| Efficacy (Lumens per Watt—LPW) | 68 | 50 | 15 | 51 |
| Color Accuracy (CRI) | 92 | 87 | 100 | 82 |
| Correlated Color Temperature (CCT) | 3000 | 3000 | 2950 | 3000 |

With reference to Table 1 above, the wattage (Watts), luminous flux (Lumens), efficacy (Lumens per Watt, LPW), color accuracy (CRI), and correlated color temperature (CCT) for a LED lamp 100 consistent with the present disclosure, an ULTRA LED PAR38 led lamp 10 (FIG. 1), a standard PAR38 halogen lamp, and a standard PAR38 high-intensity discharge (HID) lamp is generally illustrated. Because the heat sink 104 consistent with the present disclosure is able to dissipate more heat compared to the prior art LED 10, the LED lamp 100 is able to operate at 24.3 watts whereas the prior art LED lamp 10 is designed to be operated at 18 watts. Moreover, even with the higher power level, the LED lamp 100 of the present disclosure achieves a higher efficacy of 68 LPW compared to only 50 LPW for the prior art LED lamp 10 (an improvement of 36% compared to the prior art LED lamp 10). The higher efficacy and wattage of the LED lamp 100 due to the increased thermal performance of the heat sink 104 allows the LED lamp 100 to generate 1650 lumens whereas the prior art LED lamp 10 generates 900 lumens (an improvement of 83% more lumens compared to the prior art LED lamp 10).

The above results for the LED lamp 100 are unexpected since driving a lamp at higher wattages is typically more difficult because the heat sink acts as a thermal limit to the overall performance of the lamp. More specifically, driving an LED lamp at a higher wattage typically increases the steady-state operating temperature, which reduces the lifespan of the driver circuitry (e.g., the electrical capacitor, i.e., "E-Cap") thereby shortening the lifespan of the LED lamp. As a result, the wattage and luminous flux of the lamp must generally be reduced in order to achieve a satisfactory lifespan. Because the heat sink 104 of the LED lamp 100 of the present disclosure dissipates more thermal energy compared to the prior art LED lamp 10, the LED lamp 100 of the present disclosure is believed to have a lifespan similar to the lifespan of the prior art LED lamp 10, despite the increased wattage and luminous flux. As may be appreciated, lifespan is estimated based on calculations at 70% lumen maintenance.

Referring now to FIGS. 13-17, various dimensions of one embodiment of a heat sink 104 consistent with the present disclosure is provided for illustrative purposes only. It should be appreciated that the heat sink 104 consistent with the present disclosure is not limited to the exemplary dimensions. Most of the reference numerals have been intentionally left out of FIGS. 13-18 for the sake of clarity. The heat sink 104 has the following dimensions from Equations 1-8: R1=58.5 mm; R2=36.6 mm; R3=49.0 mm; R4=51.0 mm; C=0.60 mm; W=3.0 mm; and D=2.35 mm. Various other dimensions are provided in FIGS. 13-18, though they will not be described in detail for the sake of brevity.

Accordingly, a heat sink assembly 104 consistent with the present disclosure increases the effective thermal contact area of the heat sink 104 with the surrounding ambient air. Moreover, a heat sink 104 consistent with the present disclosure unexpectedly increases the airflow across the heat sink 104. As a result, the heat sink 104 transfers more thermal energy from the LEDs 103 to the surrounding ambient air. Consequently, the thermal performance of the heat sink 104 may be increased, the LED's junction temperature may be reduced, and the total lumen output of the LED's 103 of the LED lamp 100 may be increased.

Consistent with at least one embodiment, the present disclosure features an improved heat sink for a light emitting diode (LED) lamp assembly. The improved heat sink includes a monolithic heat sink having a core region formed about a longitudinal axis and having a lower end and an opposite upper end, a lower rim being formed adjacent the lower end, and an upper thermal ring formed proximate the upper end. The upper thermal ring is disposed in spaced relation from the core region and extends substantially about an entire circumference of the heat sink. The heat sink defines, adjacent to the lower peripheral rim, a first region configured to receive in operative electrical and mechanical association an electrical connector. The heat sink further defines a second region proximate the upper end, the second region configured to receive at least one LED and oriented to direct light outward from the heat sink. The heat sink further includes a plurality of longitudinal vanes formed on an outwardly directed surface of the core region and extending generally along the longitudinal axis from the lower rim towards the upper end. The vanes intersect and support the upper thermal ring, the vanes and the upper thermal ring bounding, as viewed in a direction along the longitudinal axis, air flow apertures. The heat sink also includes a plurality of webs formed between adjacent pairs of the longitudinal vanes. The webs collectively define an auxiliary thermal ring which substantially circumferentially surrounds in spaced relation the core region and is disposed, as viewed in the longitudinal direction, between the upper thermal ring and the lower rim. Each of the longitudinal vanes defines a respective thermal notch formed on a vane surface facing an adjacent longitudinal vane. The thermal notch is in confronting relationship to a respective the air flow aperture. The heat sink can be used in combination with at least one or more LEDs, an electrical connector, and driver circuitry operatively electrically connected to the electrical connector and the one or more LEDs.

As used in any embodiment herein, "circuitry" may comprise, for example, singly or in any combination, hardwired circuitry, programmable circuitry, state machine circuitry, and/or firmware that stores instructions executed by programmable circuitry. In at least one embodiment, the light module 102 and/or the electrical module 106 may include a controller, photodetector, PWM circuitry and/or driver circuitry 150, FIG. 2, configured to convert an AC signal into a DC signal at a desired current and voltage, and/or generate one or more control signals to adjust the operation of the light module 102, for example, the brightness (e.g., a dimmer circuitry) of the LEDs 103, color of the light emitted from the LEDs 103 (e.g., the LED light assembly 100 may include two or more LEDs 103 configured to emit light having different wavelengths, wherein the driver circuitry may adjust the relative brightness of the different LEDs 103 in order to change the mixed color from the LED lamp 100), adjust for changes in ambient lighting conditions (e.g., an ambient light sensor), adjust for temperature changes, adjust for changes in output due to lifetime changes, and the like. The controller, photodetector, PWM circuitry and/or driver circuitry 150 may collectively or individually comprise one or more integrated circuits. An "integrated circuit" may be a digital, analog or mixed-signal semiconductor device and/or microelectronic device, such as, for example, but not limited to, a semiconductor integrated circuit chip.

As used herein, the designation (1)-(n) in connection with reference numerals should be interpreted as a repetition of like components (which may be identical, similar, or different). The terms "first," "second," and the like herein do not denote any order, quantity, or importance, but rather are used to distinguish one element from another, and the terms "a" and "an" herein do not denote a limitation of quantity, but rather denote the presence of at least one of the referenced item.

The term "coupled" as used herein refers to any connection, coupling, link or the like by which signals carried by one system element are imparted to the "coupled" element. Such "coupled" devices, or signals and devices, are not necessarily directly connected to one another and may be separated by intermediate components or devices that may manipulate or modify such signals.

Reference in the specification to "one embodiment" or "an embodiment" of the present disclosure means that a particular feature, structure or characteristic described in connection with the embodiment is included in at least one embodiment of the present disclosure. Thus, the appearances of the phrase "in one embodiment" appearing in various places throughout the specification are not necessarily all referring to the same embodiment.

While the principles of the present disclosure have been described herein, it is to be understood by those skilled in the art that this description is made only by way of example and not as a limitation as to the scope of the invention. The features and aspects described with reference to particular embodiments disclosed herein are susceptible to combination and/or application with various other embodiments described herein. Such combinations and/or applications of such described features and aspects to such other embodiments are contemplated herein. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

The following is a list of reference numeral used in the specification:

| | | | |
|---|---|---|---|
| 100 | LED lamp assembly | 101 | housing/body portion |
| 102 | light module | 103 | LED |
| 104 | heat sink | 105 | electrical connector |
| 106 | electrical module | 107 | lower peripheral rim |
| 108 | longitudinal vanes/fins | 110 | first region of heat sink |
| 111 | lower end | 112 | second region of heat sink |
| 113 | upper end | 114 | base of second region |
| 115 | upper thermal ring | 116 | air flow apertures |
| 117 | air flow apertures | 118 | lower peripheral ring surface |
| 120 | plurality of webs | 122 | auxiliary thermal ring |
| 123 | top surface | 126 | thermal notches |
| 127 | thermal notches | 150 | circuitry |

What is claimed is:

1. An improved heat sink (104) for a light emitting diode (LED) lamp assembly, said improved heat sink (104) comprising:

a monolithic heat sink (104) having a core region (109) formed about a longitudinal axis and having a lower end (111) and an opposite upper end (113), a lower rim (107) being formed adjacent said lower end (111), and an upper thermal ring (115) formed proximate the upper end (113), said upper thermal ring (115) being disposed in spaced relation from said core region (109) and extending substantially about an entire circumference of said heat sink (104), said heat sink (104) defining adjacent said lower peripheral rim (107) a first region (110) configured to receive in operative electrical and mechanical association an electrical connector (105), said heat sink (104) further defining a second region (112) proximate said upper end (113), said second region (112) configured to receive at least one LED (103) and oriented to direct light outward from the heat sink (104), the heat sink (104) further being formed with a plurality of longitudinal vanes (108) formed on an outwardly directed surface of said core region (109) and extending generally along said longitudinal axis from said lower rim (107) towards said upper end (113), wherein said vanes (108) intersect and support said upper thermal ring (115), said vanes (108) and said upper thermal ring (115) bounding, as viewed in a direction along said longitudinal axis, air flow apertures (116), wherein the improvement comprises:

a plurality of webs (120) formed between adjacent pairs of said longitudinal vanes (108), said webs (120) collectively defining an auxiliary thermal ring (122), said auxiliary thermal ring (122) substantially circumferentially surrounding in spaced relation said core region (109) and disposed, as viewed in said longitudinal direction, between said upper thermal ring (115) and said lower rim (107), and wherein each said longitudinal vane (108) defines a respective thermal notch (126) formed on a vane surface facing an adjacent longitudinal vane (108), said thermal notch (126) being in confronting relationship to a respective said air flow aperture (116).

2. The heat sink (104) of claim 1, wherein at least one of said plurality of webs (120) includes at least one thermal notch (127) disposed about a region intermediate adjacent pairs of longitudinal vanes (108), said webs (120) having a thickness which is thinner than at regions of intersection of said webs (122) and said vanes (108).

3. The heat sink (104) of claim 2, wherein said auxiliary thermal ring (122), said upper thermal ring (115), said plurality of vanes (108), and thermal notches (126) are arranged to satisfy the following relationships:

$$R2<R3<R1; \quad \text{Equation 1}$$

$$R2<R4<R1; \quad \text{Equation 2}$$

$$0.5*(R1+R2)<R3<0.75*(R1+R2); \quad \text{Equation 3}$$

$$0.5*(R1+R2)<R4<0.75*(R1+R2); \quad \text{Equation 4}$$

$$R3<R4; \quad \text{Equation 5}$$

wherein R1 represents an inside wall radius of said upper thermal ring (115), R2 represents an external wall radius of said base (114) of said second region (112), R3 represents an inside wall radius and R4 an external wall radius, respectively, of said auxiliary thermal ring (122), C represents a gap between a top surface (123) of said auxiliary thermal ring (122) and said lower peripheral ring surface (118) of said upper thermal ring (115), and where said radii R1, R2, R3, and R4 are measured from a centerline of the heat sink (104).

4. The heat sink (104) of claim 3, wherein said auxiliary thermal ring (122), said upper thermal ring (115), said plurality of vanes (108), and thermal notches (126) are further arranged to satisfy the following relationships:

$$C>0; \quad \text{Equation 6}$$

$$D>T; \quad \text{Equation 7}$$

$$T<W<2*T; \quad \text{Equation 8}$$

wherein T represents a minimum thickness of said vanes (108) where said thermal notch (126) is located on said vanes (108), D represents a wall thickness where said thermal notch (126) is located on said vanes (108), and W represents a width of said thermal notch (126) on said vane (108).

5. The heat sink assembly (104) of claim 2, wherein each of said plurality of webs (120) includes a first and a second thermal notch (127) disposed on opposite sides of the web (120).

6. The heat sink (104) of claim 1, wherein said upper thermal ring (115) defines a lower peripheral ring surface (118) facing said lower end (111), a position along said plurality of vanes (108) midway between said lower peripheral ring surface (118) and said lower rim (107) being defined as a vane midway position, said auxiliary thermal ring (122) being entirely disposed between said vane midway position and said lower peripheral ring surface (118).

7. The heat sink (104) of claim 1, wherein said thermal notches (126) are defined at a radial location on said longitudinal vane (108), as viewed in a radial direction extending transverse said longitudinal axis, between said auxiliary thermal ring (122) and said upper thermal ring (115).

8. The heat sink (104) of claim 1, wherein said heat sink (104) comprises a metallic material.

9. The heat sink (104) of claim 8, wherein heat sink (104) comprises a casting.

10. The heat sink (104) of claim 1, further in combination with at least:

said at least one LED (103) disposed in said second region (112);

said electrical connector (105) disposed in said first region (110); and a driver circuitry (150) operatively electrically connected to said electrical connector (105) and said at least one LED (103), the combination thereby defining an LED lamp assembly (100).

11. The heat sink (104) of claim 10, further comprising a plurality of LEDs (103).

* * * * *